United States Patent [19]

Prough et al.

[11] Patent Number: 4,731,160

[45] Date of Patent: Mar. 15, 1988

[54] DRAINAGE CHARACTERISTICS OF MECHANICAL PULP

[75] Inventors: J. Robert Prough; Michael D. Fahey, both of Glens Falls, N.Y.; Pule Calderon, Williamsport, Pa.

[73] Assignee: Kamyr, Inc., Glens Falls, N.Y.

[21] Appl. No.: 841,236

[22] Filed: Mar. 19, 1986

[51] Int. Cl.[4] ..... D21C 3/00; D21C 9/08; D21B 1/16

[52] U.S. Cl. ..... 162/55; 162/55; 162/24; 162/28; 162/78

[58] Field of Search ..... 162/24, 28, 55, 78

[56] References Cited

U.S. PATENT DOCUMENTS

| | | | |
|---|---|---|---|
| 3,016,324 | 1/1962 | Textor | 162/24 |
| 4,029,543 | 6/1977 | Lindahl | 162/24 |
| 4,160,693 | 7/1979 | Lindahl et al. | 162/24 |
| 4,294,653 | 10/1981 | Lindahl et al. | 162/78 X |
| 4,502,918 | 3/1985 | Mackie et al. | 162/24 |
| 4,606,789 | 8/1986 | Reinhall | 162/55 X |

FOREIGN PATENT DOCUMENTS

| | | | |
|---|---|---|---|
| 1071805 | 2/1980 | Canada | 162/24 |

OTHER PUBLICATIONS

Lindholm et al., No. 11, 1978, Paperi ja Puu—Papper och Trä, "Modification of Groundwood Pulp Through Chemical Treatment of the Coarse Fibre Fraction."

Britt, Handbook of Pulp and Paper Technology, 2nd ed., Van Nostrand Reinhold Company, 1970, pp. 315–321.

*Primary Examiner*—Peter Chin
*Assistant Examiner*—Thi Dang
*Attorney, Agent, or Firm*—Nixon & Vanderhye

[57] ABSTRACT

A method and apparatus provide for the bleaching of mechanical pulp in such a way that the brightness of the mechanical pulp can be increased up to about 7–10 points. Mechanical pulp directly from a secondary refiner is separated, as by first and second centrifugal separators (cyclones), into a fines fraction and a fiber fraction. The fines fraction is under about 200 mesh. The fiber fraction is mixed with hydrogen peroxide ($H_2O_2$) and subjected to displacement bleaching, which uses a minimum about of bleaching chemical to obtain the maximum brightness. The fines fraction is mixed with hydrogen peroxide and subjected to non-displacement bleaching. The fines fraction is between about 10–20 percent of the total feed pulp stream. After bleaching, the fines and fiber streams can be recombined before passage to a paper products production machines.

7 Claims, 2 Drawing Figures

DRAINAGE CHARACTERISTICS OF MECHANICAL PULP

BACKGROUND AND SUMMARY OF THE INVENTION

During the production of pulps by fine mechanical means (that is utilizing refiners (defibrators)), a portion of the material which is produced is very fine, typically having a size under about 200 mesh. The drainage characteristics of this fines fraction is poor, in fact it is so poor that it adversely affects the drainage characteristics of the entire pulp stream even though it typically makes up only about 10–20 percent of the entire pulp stream. Because of the poor drainage characteristics it is impractical to use displacement bleaching or washing techniques, with the result that the pulp can be bleached only to brightness levels which are less than theoretically possible.

It is highly desirable to be able to use displacement bleaching and washing techniques in the treatment of mechanical pulp since displacement bleaching has been shown to be a way to obtain the maximum removal of water and metal ions contained within the pulp lattice, using a minimum amount of water or bleaching chemical. Displacement bleaching allows a maximum bleaching to take place, with a minimum amount of bleaching chemical.

Because of the poor drainage characteristics of conventional mechanical pulps, two or more stages of bleaching have been proposed in order to give a higher brightness, but such stages result in improved bleaching only up to the point that the level of metal ions, and like contaminants within the pulp, rise to an unacceptable level. Therefore in present commercial practice the brightness ceiling for mechanical pulps is on the order of 75 GE. If this level could be increased about 7–10 points, mechanical pulp would be acceptable in many markets where it is now precluded. However since hydrogen peroxide, the conventional bleaching chemical utilized in mechanical pulp bleaching, is very expensive, this additional increase in brightness must be achieved with an acceptable peroxide consumption.

According to the present invention, it is possible to produce mechanical pulp having a higher brightness than the present practical ceiling of 75 GE, and it can be produced in a cost-effective manner. According to the present invention, a maximum increase in brightness can be obtained for a minimum consumption of hydrogen peroxide, by improving the drainage characteristics of the majority of the mechanical pulp so that it can be treated by displacement washing and/or bleaching.

According to the present invention, a first stream of mechanical pulp is separated into a minor fines fraction and a major fiber fraction. The separation may be accomplished utilizing a screen, or a pair of centrifugal separators (cyclones), the first cyclone separating the major fiber fraction from the fines, and the second connected to the fines discharge from the first and separating the fines from a fluid containing steam. A portion of the fluid containing steam which is separated by the second separator may be recycled to the inlet to the first separator. The major fiber fraction may be subjected to displacement bleaching utilizing a suitable bleaching chemical, such as hydrogen peroxide, to produce a bleached mechanical pulp having higher brightness per unit of hydrogen peroxide consumed than if the stream of mechanical pulp were bleached without the separation stage. The fines fraction also is preferably bleached utilizing hydrogen peroxide, with non-displacement bleaching techniques.

It is the primary object of the present invention to provide a method and apparatus for improving the drainage characteristics of mechanical pulp to ultimately allow the production of bleached mechanical pulp with a higher brightness and/or with a maximum brightness per unit of hydrogen peroxide consumed. This and other objects of the invention will become clear from an inspection of the detailed description of the invention, and from the appended claims.

DETAILED DESCRIPTION OF THE DRAWINGS

Figure 1:
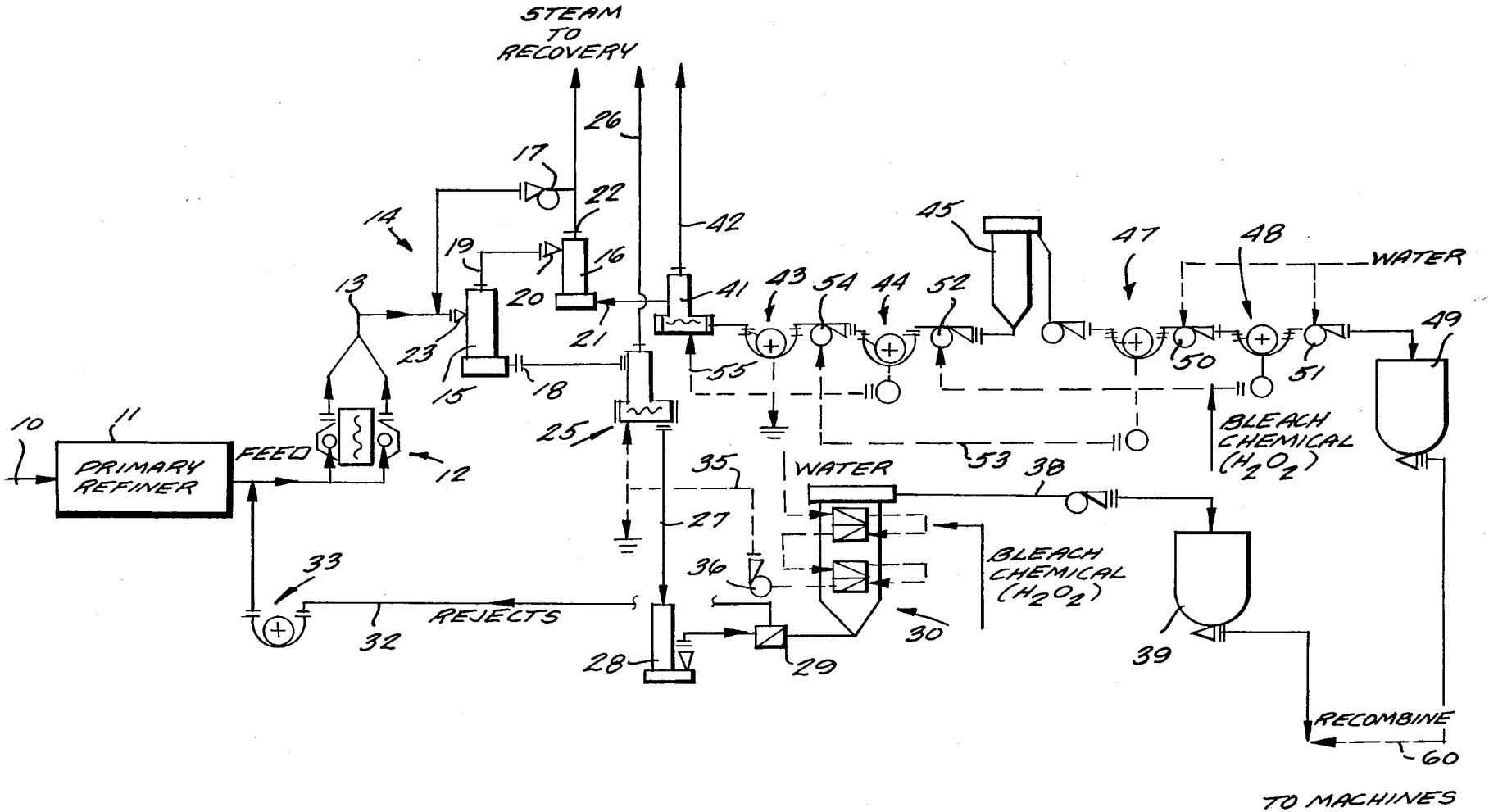
FIG. 1 is a schematic illustration of the interconnection of exemplary apparatus according to the present invention for producing bleached mechanical pulp according to the present invention.

FIG. 1 shows one form of exemplary apparatus for producing bleached mechanical pulp according to the present invention. Wood chips in a high consistency slurry in line 10 are fed to a primary refiner 11, and from the primary refiner 11 to a secondary refiner 12. The refiners 11, 12 are conventional. The pulp discharge line 13 from the secondary refiner 12 leads to a separating means 14 for separating the pulp stream into a minor fines fraction and a major fiber fraction. The separating means 14 preferably comprises, as illustrated in FIG. 1, a first centrifugal separator (cyclone) 15, a second centrifugal separator 16, and a recycle fan 17. The cyclone 15 separates the major fiber fraction from the fines, having a major fiber fraction discharge 18 and a fines discharge 19. The fines discharge 19 leads to the inlet 20 to the second separator 16, and from the second separator 16 the fines are discharged from discharge 21 while a fluid which contains steam is discharged from discharge 22. A portion of the steam is lead to a conventional steam recovery station (not shown), while another portion is recycled by the fan 17 to the line 13 just prior to the inlet 23 to the first cyclone 15.

The major fiber fraction discharged from discharge 18 from cyclone 15 preferably is mixed with bleaching chemical (ordinarily hydrogen peroxide) and other liquid in conventional mixer 25. Some steam is evolved from the mixer 25 and this passes in line 26 to the steam recovery station. The slurry of pulp mixed with hydrogen peroxide that is discharged from the mixer 25 passes in line 27 to the stand pipe 28, from which the pulp is pumped through screening apparatus 29 to a displacement bleaching apparatus 30. The screening apparatus 29 preferably comprises a commercially available screening apparatus sold by Kamyr, Inc. of Glens Falls, N.Y. and Kamyr AB of Karlstad, Sweden under the trademark "MC". The rejects from the screening apparatus 29 pass in line 32 to a press 33 which thickens the stream and from there the thickenes rejects stream is fed back to the first pulp stream just before the secondary refiner 12.

The displacement bleaching apparatus 30 is a conventional displacement bleaching apparatus sold by Kamyr, Inc. and Kamyr AB and may be of the type such as illustrated in U.S. Pat. Nos. 3,704,603 or 3,815,386. The water and bleaching chemical (preferably hydrogen peroxide) are added to the displacement apparatus at the points illustrated, and the spent liquid withdrawn from the apparatus 30, in line 35, by pump 36 is fed to the mixer 25 wherein it is mixed with the pulp from cyclone 15. The liquid in line 35 contains some hydrogen peroxide.

The pulp in the major fiber fraction has sufficient drainage characteristics so that it may be readily treated in the displacement bleaching apparatus 30. The bleached pulp produced passes from apparatus 30 in line 38 to a storage tank 39 or the like, and ultimately passes to a suitable machine for the production of paper products from the pulp.

It is also desirable to bleach the fines fraction. The fines discharged from the discharge 21 of the second cyclone 16 passes to mixer 41, with steam discharged from the mixer 41 passing in line 42 to the steam recovery station. The pulp passes into operative association with conventional presses 43 and 44 to a conventional bleaching tower 45, which is of the non-displacement type. The fines fraction is incapable of being treated by displacement bleaching because of its drainage characteristics. After bleaching in tower 45, the fines fraction of bleached pulp preferably passes through presses 47 and 48 ultimately to a storage container 49.

Bleaching chemical (hydrogen peroxide) is added to the liquid withdrawn from press 48, while water is added to the pump 50 between presses 47 and 48, and the pump 51 between press 48 and storage tank 49. The bleaching chemical is intimately mixed with the fines fraction in the pump 52, which preferably is of the type sold by Kamyr, Inc. and Kamyr AB under the trademark "MC". The liquid withdrawn from press 47 is fed by line 53 to pump 54 between presses 43 and 44, and the liquid from press 44 is fed by line 55 to the mixer 41. The liquid in line 55 contains some bleaching chemical.

The pulp from storage tank 49 is passed to conventional machinery for producing paper products. Preferably, the minor fines and major fiber fractions would be recombined, as indicated by dotted line 60 in FIG. 1, prior to passage to the paper product production machinery.

In one exemplary utilization of the apparatus of FIG. 1, considering a feed of pulp of 250 tons per day, the cyclone 15 is operated so that the fines fraction includes that portion of the solid part of the pulp having a size under about 200 mesh, while the major fiber fraction contains the rest. Typically then, the flow in the major fiber fraction portion would be about 200–225 tons per day, while the fines flow stream would be about 25–50 tons per day (i.e. about 10–20 percent of the feed pulp). If, for purposes of discussion, the fines stream is considered to be 20 percent of the original feed (i.e. 50 tons per day), and the fines and major fiber fractions are treated separately, the major fiber fraction would be treated with 2.5 percent peroxide, while the fines fraction would be treated with 5 percent peroxide. This would mean that the total peroxide for the entire stream would be 3.0 percent. This should be compared to 5 percent peroxide which would be required if the entire stream were treated together (without separation of the fines). Thus utilizing the invention it would be possible to increase the ceiling on mechanical pulp brightness to above the 75 GE level by about 7–10 points, in a cost-effective manner since the consumption of bleaching chemical is minimized.

In actual tests it was found that by removal of fines (less than 200 mesh in size), the mechanical pulp behaved just like conventional Scandinavian softwood kraft pulp, that is it had excellent to normal drainage properties. This was noticeable by measuring the Pulmac and CSF drainage data, and by measuring the specific surface (V*S). The specific surface was dramatically reduced. For example in one case where non-fractionated spruce mechanical pulp was compared to the same pulp only fractionated, the specific surface was reduced from 3319 for non-fractionated to 1080 for fractionated. The fractionated major fiber fraction was entirely suitable as far as drainage characteristics were concerned for displacement bleaching, while the non-fiber fraction was not.

Figure 2:
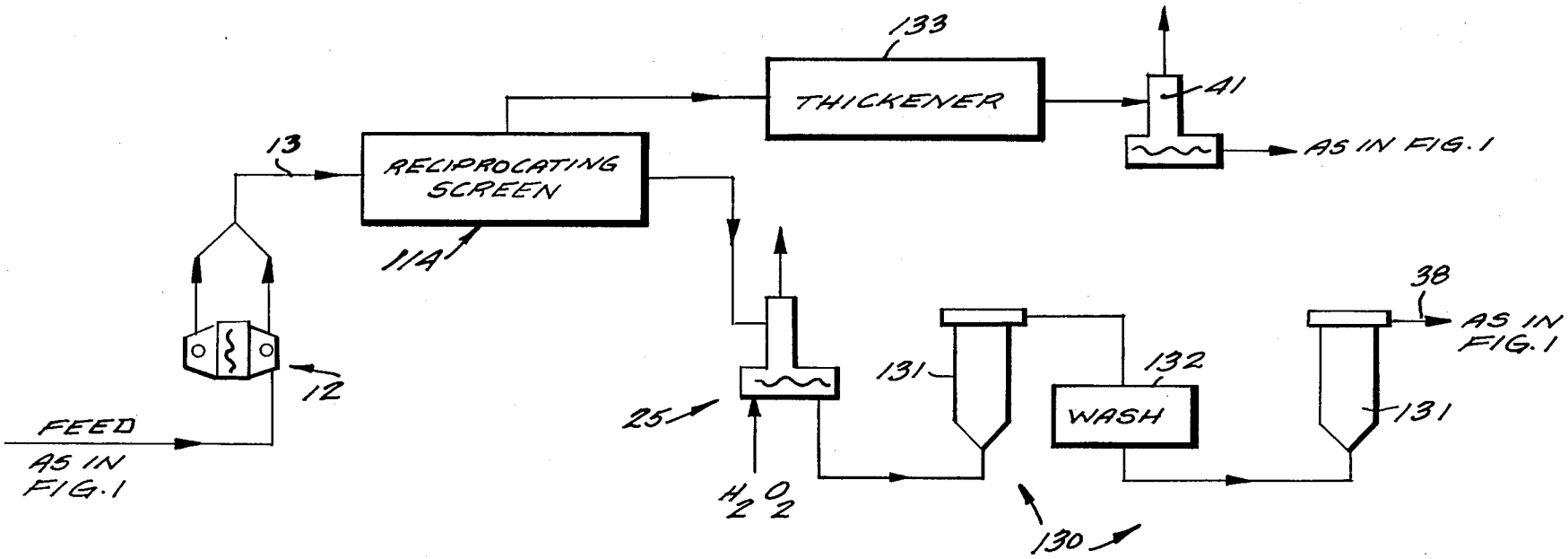
FIG. 2 is a view like that of FIG. 1 only showing alternative apparatus that may be used for effecting separation of the major fibers and fines fractions, and for bleaching of the major fiber fraction.

While it is preferred that according to the present invention the major fiber and minor fines fractions be separated utilizing centrifugal separators 15, 16 as illustrated in FIG. 1, and that bleaching of the major fiber fraction be done utilizing the displacement bleaching apparatus 30 illustrated in FIG. 1, the invention is also applicable to other separation and bleaching techniques. FIG. 2 schematically illustrates another exemplary form of apparatus according to the present invention like that of FIG. 1 only utilizing a different separating apparatus and fiber fraction bleaching apparatus. In the embodiment of FIG. 2 portions of the apparatus identical to those in FIG. 1 are not illustrated.

In FIG. 2, the pulp discharged in line 13 from secondary refiner 12 passes to a separator in the form of the reciprocating screen 114. The reciprocating screen may be of the type illustrated, for example, in U.S. Pat. No. 4,029,579, or may comprise any type of screening apparatus in which fines (e.g. having a size under about 200 mesh) may be effectively separated from the major fiber fraction without clogging. From the reciprocating screen 114 the major fiber fraction is passed to mixer 25, and ultimately to bleaching apparatus 130, which may comprise one or more conventional bleaching towers 131 which may have an intermediate wash stage 132. The fines portion from the reciprocating screen 114 preferably is passed to thickener 133, and from there to the mixer 41.

It will thus be seen that according to the present invention a method and apparatus have been provided which result in the cost-effective production of mechanical pulp having enhanced brightness, and/or has a maximum brightness increase per unit of hydrogen peroxide consumed. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods, apparatus, and products.

What is claimed is:

1. A method of producing bleached mechanical pulp, comprising the steps of:

(a) separating a stream of mechanical pulp directly from a primary refiner into a minor fines fraction comprising at least 80% of the pulp having a size under about 200 mesh, and a major fiber fraction having a size above about 200 mesh, the major fraction having better drainage characteristics relative to the drainage characteristics of said stream of mechanical pulp;

(b) non-displacement bleaching the minor fraction with hydrogen peroxide;

(c) displacement bleaching the major fraction with hydrogen peroxide to produce a bleached mechanical pulp having higher brightness per unit of hydrogen peroxide consumed than if the stream of mechanical pulp were bleached without the practice of step (a); and (d) combining the bleached fractions from steps (b) and (c) to obtain said bleached mechanical pulp.

2. A method as recited in claim 1 wherein step (a) is practiced by passing said stream of pulp, directly after refining, to a first centrifugal separator which discharges fines at one point, and said major fiber fraction at another; passing the fines discharged from the first centrifugal separator to a second centrifugal separator which discharges fines from one point, and steam containing fluid from another.

3. A method as recited in claim 2 wherein step (a) is further practiced by recycling a portion of the steam-containing fluid from the second centrifugal separator to an inlet to the first centrifugal separator.

4. A method as recited in claim 3 wherein step (c) is practiced by mixing hydrogen peroxide with the pulp in a mixer, screening the hydrogen peroxide/pulp slurry to remove rejects displacement bleaching said pulp slurry with said hydrogen peroxide after said rejects are removed from the pulp slurry concentrating and returning the rejects to said stream; and refining said stream, with returned rejects, in a secondary refiner.

5. A method as recited in claim 1 wherein step (c) is practiced by mixing hydrogen peroxide with the pulp in a mixer, screening the hydrogen peroxide/pulp slurry to remove rejects displacement bleaching said pulp slurry with said hydrogen peroxide after said rejects are removed from the pulp slurry; concentrating and returning the rejects to said stream; and refining said stream, with returned rejects, in a secondary refiner.

6. A method as recited in claim 1 wherein step (a) is practiced by passing said stream of pulp, directly after refining, to a first centrifugal separator which discharges fines at one point, and said major fiber fraction at another; passing the fines discharged from the first centrifugal separator to a second centrifugal separator which discharges fines from one point, and steam-containing fluid from another, and further recycling a portion of the steam containing fluid from the second separator to an inlet to the first separator.

7. A method as recited in claim 1 wherein step (a) is practiced by passing said pulp stream over a reciprocating screen, the screen having openings formed therein large enough to allow the passage of fines, but small enough to prevent the passage of the non-fines fiber material.

* * * * *